US008959817B1

(12) United States Patent
Barnes

(10) Patent No.: US 8,959,817 B1
(45) Date of Patent: Feb. 24, 2015

(54) MAGNETIC FRAME ARRANGEMENTS

(71) Applicant: The Sweetheart Gallery, Inc., Hinsdale, IL (US)

(72) Inventor: Mary E. Barnes, Hinsdale, IL (US)

(73) Assignee: The Sweetheart Gallery, Inc., Hinsdale, IL (US)

( * ) Notice: Subject to any disclaimer, the term of this patent is extended or adjusted under 35 U.S.C. 154(b) by 0 days.

(21) Appl. No.: 14/259,256

(22) Filed: Apr. 23, 2014

Related U.S. Application Data

(60) Provisional application No. 61/964,409, filed on Jan. 6, 2014.

(51) Int. Cl.
*A47G 1/06* (2006.01)
*G09F 7/04* (2006.01)

(52) U.S. Cl.
CPC ... *G09F 7/04* (2013.01); *A47G 1/06* (2013.01)
USPC ..... 40/711

(58) Field of Classification Search
CPC ... A47G 2001/0672; A47G 1/06; A47G 1/14; G09F 1/12; G09F 7/04
USPC ..... 40/711, 661.01, 600
See application file for complete search history.

(56) References Cited

U.S. PATENT DOCUMENTS

| | | | | |
|---|---|---|---|---|
| 5,075,991 | A | 12/1991 | Wenkman et al. | |
| 6,185,850 | B1 | 2/2001 | Erkel | |
| 6,209,248 | B1 | 4/2001 | Reinhard | |
| 6,293,038 | B1 | 9/2001 | Chang | |
| 6,354,030 | B1 | 3/2002 | Harris | |
| 6,688,029 | B1 | 2/2004 | Dunn | |
| 7,219,460 | B1 * | 5/2007 | Grayson | 40/711 |
| 7,406,792 | B2 * | 8/2008 | Chang | 40/781 |
| 8,047,851 | B1 | 11/2011 | Baxter | |
| 2006/0143964 | A1 | 7/2006 | Chatellier et al. | |
| 2011/0303814 | A1 | 12/2011 | Schultz | |
| 2013/0160338 | A1 * | 6/2013 | Forbis | 40/711 |

FOREIGN PATENT DOCUMENTS

| | | | |
|---|---|---|---|
| EP | 2377435 | A1 * | 10/2011 |
| JP | 11-299610 | A * | 11/1999 |

OTHER PUBLICATIONS

Wexel Art—New York Times Reprints, Sales on Alessi Products, Lighting and More, Oct. 20, 2010.
Wexel Webpages and Wexei Art TM Registration, Feb. 28, 2012.
Webpages, Snap Magnetic Frame by Umbra, circa Apr. 27,2012.
Webpages, mcgpaper Clear Snap Together Buttons, circa 1999.
Webpages, Banner Grip, circa 1992.

(Continued)

*Primary Examiner* — Casandra Davis
(74) *Attorney, Agent, or Firm* — Cook Alex Ltd.

(57) ABSTRACT

Frame arrangements with magnetic assembly features have a frame with a body and a rabbet containing embedded magnets, a lens through which items to be displayed in visible fashion can be viewed, and a backing plate. The lens has a plurality of embedded magnets, and the backing plate is receptive to magnetic attraction with respect to the magnets embedded into the lens, into the frame or both. When desired, the frame arrangement has multipurpose characteristics in that the backing plate can be easily reoriented and provide dry-erase capabilities such that the frame arrangement not only provides a framing function but also is able to provide a message board or similar function.

20 Claims, 4 Drawing Sheets

(56) References Cited

OTHER PUBLICATIONS

Webpages, Dime Designs in Machine Embroidery, printed Mar. 24, 2014.

Webpages, snapframesdirect.com, 2013.

Webpages, Snap Frames Clip Open Poster Holders for Quick Changes, printed Mar. 24, 2014.

Webpages, Fast Change Display Frames , circa 1992, printed Mar. 24, 2014.

* cited by examiner

FIG.8
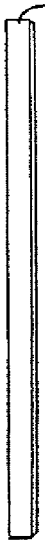
FIG.7
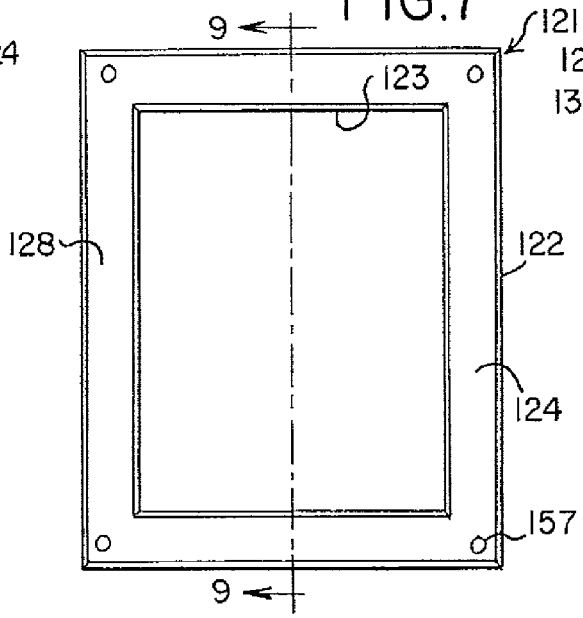
FIG.9
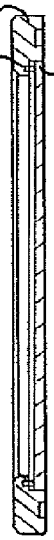
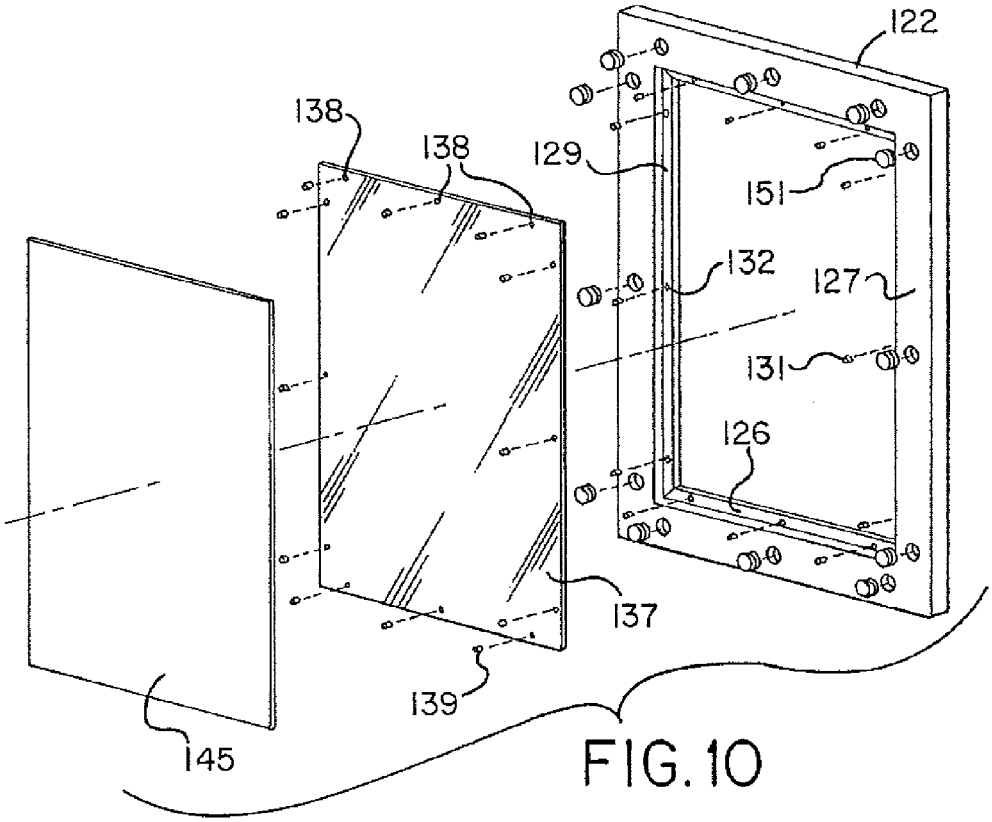
FIG.10

MAGNETIC FRAME ARRANGEMENTS

CROSS REFERENCE TO RELATED APPLICATION

This application claims the benefit of U.S. Provisional application Ser. No. 61/964,409, filed Jan. 6, 2014, incorporated by reference hereinto.

BACKGROUND

1. Field of the Disclosure

The present subject matter relates to magnetic frames, arrangements, magnetic frame kits and magnet frame assemblies, and particularly to multi-piece magnetic frame devices that easily assemble and dis-assemble for use. Included are magnetic frame devices that have multi-purpose features.

2. Description of Related Art

Picture frames and other framing devices are known for displaying various works of art, photographs, paintings, informational materials, awards, children's papers, and the like, often framing two-dimensional items. Typically these are designed to rest on a generally horizontal surface such as a table, desk or dresser, and/or to be suspended from a generally vertical wall or the like, with the objective of adding decorative and personal touches to a location or a piece of furniture or a fixture, such as a room, a wall or a table or dresser. Usually, picture frames and other framing devices have a single function intended to comply with such objectives.

Certain household and/or office products or devices having supporting and/or framing functions incorporate magnetic features directed to objectives such as providing magnetic strips and magnetic attachment members for purposes of assembly and dis-assembly of components of such devices. Other magnetic framing devices have organizing objectives and do not necessarily add a framing or a decorative element or enhancement.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as may be set forth in the claims appended hereto.

As with other framing devices, the present frame assemblies are provided to encase and display sheets or panels that have a decorative or informative element, such as works of art, photographs, paintings, informational materials, awards and the like, many being of a two-dimensional or sheet variety. The present disclosure accomplishes these types of framing objectives, while also providing for magnetic assembly and disassembly when desired to replace one displayed item or items with another item or items to be displayed in the magnetic frame unit.

In achieving these types of functions and objectives, the present disclosure seeks to achieve such functions and objectives, and when desired added function and objective achievement. This is carried out in a secure magnetic manner that is readily accomplished by a user after no, or only minimal, instruction and without needing tools of any type.

In one aspect of this disclosure, a magnetic frame arrangement is provided that includes a frame component having a perimeter body with a first surface and an oppositely facing second surface. An open central area is defined within the perimeter body, and a rabbet along at least a portion of the frame component is positioned between the perimeter body and the open area, the rabbet having an instep face generally parallel to the second surface and between the first and second surfaces. A plurality of magnets are embedded at selected locations into the instep face of the rabbet. Also included is a transparent lens having a plurality of magnets embedded thereinto at a plurality of lens locations, at least some of which substantially align with at least some of the selected locations of the rabbet. Further included is a backing plate made of a material that is receptive to magnetic attraction with respect to the magnets embedded into the lens, into the rabbet instep face, or both.

In another aspect of this disclosure, a magnetic frame arrangement is provided that includes a frame component having a perimeter body with a first surface and an oppositely facing second surface. An open central area is defined within the perimeter body, and a rabbet along at least a portion of the frame component is positioned between the perimeter body and the open area, the rabbet having an instep face generally parallel to the second surface and between the first and second surfaces. A plurality of magnets are embedded at selected locations into the instep face of the rabbet. Also included is a transparent lens having a plurality of magnets embedded thereinto at a plurality of lens locations, at least some of which substantially align with at least some of the selected locations of the rabbet. Further included is a backing plate made of a material that is receptive to magnetic attraction with respect to the magnets embedded into the lens, into the rabbet instep face, or both. In addition, at least one magnet is located at the second surface of the perimeter body in order to provide magnetic forces to mount the magnetic frame arrangement to surfaces that are receptive to magnetic attraction.

In a further aspect of this disclosure, a multi-purpose magnetic frame arrangement is provided that includes a frame component having a perimeter body with a first surface and an oppositely facing second surface, an open central area, and a rabbet along the interior perimeter of the perimeter body to define the open central area, the rabbet having a step-down ledge generally parallel to the second surface and between the first and second surfaces. A plurality of magnets are embedded at selected locations into the step-down ledge of the rabbet, and a transparent lens having a plurality of magnets embedded thereinto at a plurality of lens locations at least some of which substantially align with at least some of the selected locations of the rabbet as pairs of aligned magnets. Also included is a backing plate receptive to magnetic attraction with respect to the magnets embedded into either the lens or into the step-down ledge, this backing plate having at least one surface with dry-erase capabilities. These pairs of aligned magnets selectively magnetically engage and disengage the frame component, the lens, and the backing plate in a front-to-back order that can be varied as desired according to the needs of the user. One front-to-back order has the frame component over the lens which is over the backing plate. Another has the frame component over the backing plate which is over the lens. In at least one of these arrangements, the surface having dry-erase capabilities is positioned within the open central area and is accessible to the user for marking and erasing indicia on the backing plate.

In yet a further aspect of this disclosure, a multi-purpose magnetic frame arrangement is provided that includes a frame component having a perimeter body with a first surface and an oppositely facing second surface, an open central area, and a rabbet along the interior perimeter of the perimeter body to define the open central area, the rabbet having a step-down ledge generally parallel to the second surface and between the first and second surfaces. A plurality of magnets are embedded at selected locations into the step-down ledge of the rabbet, and a transparent lens having a plurality of magnets embedded thereinto at a plurality of lens locations at least some of which substantially align with at least some of the selected locations of the rabbet as pairs of aligned magnets. Also included is a backing plate receptive to magnetic attraction with respect to the magnets embedded into either the lens or into the step-down ledge, this backing plate having at least one surface with dry-erase capabilities. These pairs of aligned magnets selectively magnetically engage and disengage the frame component, the lens, and the backing plate in a front-to-back order that can be varied as desired according to the needs of the user. One front-to-back order has the frame component over the lens which is over the backing plate. Another has the frame component over the backing plate which is over the lens. In at least one of these arrangements, the surface having dry-erase capabilities is positioned within the open central area and is accessible to the user for marking and erasing indicia on the backing plate. In addition, at least one magnet is located at the second surface of the perimeter body in order to provide magnetic forces to mount the magnetic frame arrangement to surfaces that are receptive to magnetic attraction.

In an additional aspect of this disclosure, a multi-purpose magnetic frame kit is provided that is purposed for either framing of pictures or the like or for dry-erase board uses. The kit includes a frame component having a frame body with a first surface and an oppositely facing second surface, an open central area, and a rabbet along the interior perimeter of the frame body to define the open central area, the rabbet having a step-down ledge generally parallel to the second surface in between the first and second surfaces. A plurality of kit-securing magnets located at the second surface of the frame body are countersunk within the frame body from its second surface and are configured to magnetically secure the multi-purpose kit to a separate surface to which the kit-securing magnet and thus the kit magnetically adhere. A plurality of magnets are embedded at selected locations into the step-down ledge of the rabbet, and a plurality of magnets are embedded into a transparent lens that are located at a plurality of lens locations at least some of which substantially align with at least some of the selected locations of the rabbet in order to provide pairs of aligned magnets. Also included in the kit is backing plate receptive to magnetic attraction with respect to the magnets embedded into the lens, into the step-down ledge, or both. The backing plate has at least one surface with dry-erase capabilities. The pairs of aligned magnets selectively magnetically engage and disengage the frame component, the lens, and the backing plate in a front-to-back order that can be varied depending upon the use to which the user intends to put the kit. In an embodiment, the first surface of the frame body is decorative. In a further embodiment, the kit includes a magnetic stand.

In an added aspect of this disclosure, a magnetic frame is provided with a frame component having a frame body of a type including a rabbet along at least a portion of the frame component between the frame body and an open central area. A plurality of magnets are embedded at selected locations along the rabbet, and a transparent lens is provided with a plurality of magnets embedded thereinto at a plurality of lens locations, at least some of which substantially align with at least some of the selected locations of the rabbet magnets. Further included is a backing plate receptive to magnetic attraction with respect to the magnets embedded into the lens, the instep face, or both. With this arrangement, the lens and the backing plate both magnetically engage and are disengageable by breaking magnetic engagement from each other and from the rabbet so as to be configured in order to display a decorative or informative sheet between the backing plate and the lens such that the sheet is visible at the open area of the frame.

In a further aspect of this disclosure, a magnetic frame is provided with a frame component having a frame body of a type including a rabbet along at least a portion of the frame component between the frame body and an open central area. A plurality of magnets are embedded at selected locations along the rabbet, and a transparent lens is provided with a plurality of magnets embedded thereinto at a plurality of lens locations, at least some of which substantially align with at least some of the selected locations of the rabbet magnets. Further included is a backing plate receptive to magnetic attraction with respect to the magnets embedded into the lens, the instep face, or both. With this arrangement, the lens and the backing plate both magnetically engage and are disengageable by breaking magnetic engagement from each other and from the rabbet so as to be configured in order to display a decorative or informative sheet between the backing plate and the lens such that the sheet is visible at the open area of the frame. At least one magnet is located along the frame body to provide the ability of the frame to magnetically adhere to a separate surface to which such magnets magnetically adhere. In an embodiment, each such frame body magnet is magnetically accessible by the separate surface from the second surface of the frame body. In a further embodiment each such frame body magnet is magnetically accessible by the separate surface from the first surface of the frame body. In a further embodiment, each such frame body magnet is magnetically accessible by the separate surface from the first and second surface of the frame body.

In yet another aspect of this disclosure, a magnetic frame arrangement is provided that includes a frame component having a perimeter body, an open central area is defined within the perimeter body, and a rabbet along at least a portion of the frame component is positioned between the perimeter body and the open area, the rabbet having an instep face generally parallel to the second surface and between the first and second surfaces. A plurality of magnets are embedded at selected locations into the instep face of the rabbet. Also included is a lens having a plurality of magnets embedded thereinto at a plurality of lens locations, at least some of which substantially align with at least some of the selected locations of the rabbet. Further included is a backing plate made of a material that is receptive to magnetic attraction with respect to the magnets embedded into the lens, into the rabbet instep face, or both. In an embodiment, a plurality of magnets are molded into the rabbet and/or into the lens, typically during their respective manufacture. In a further embodiment, at least one magnet is located on the perimeter body in order to provide magnetic forces to mount the magnetic frame arrangement to surfaces that are receptive to magnetic attraction, such magnet having been capture molded during frame manufacture.

BRIEF DESCRIPTION OF THE DRAWINGS

FIG. 7 is a front plan view of a further embodiment of a magnetic frame arrangement, assembly or kit according to the present disclosure;

FIG. 8 is a side elevational view of the embodiment illustrated in FIG. 7;

FIG. 9 is a cross-sectional view of the magnetic device, taken along the line 9-9 of FIG. 7;

FIG. 10 is an exploded perspective view of the embodiment illustrated in FIG. 7;

DESCRIPTION OF THE ILLUSTRATED EMBODIMENTS

Figure 1:
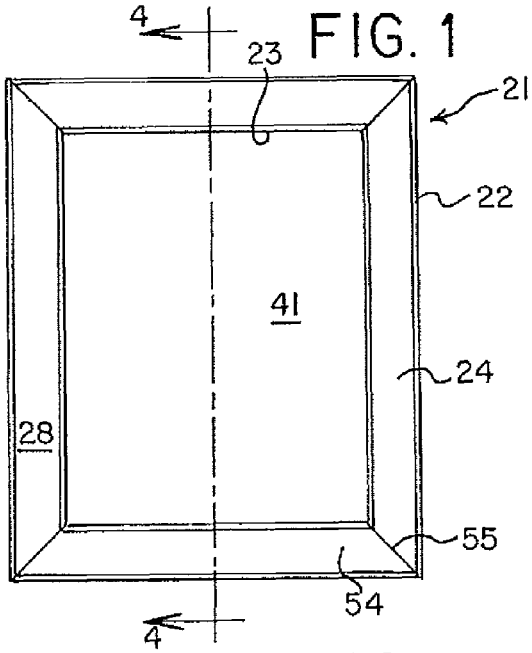
FIG. 1 is a front plan view of a magnetic frame arrangement, assembly or kit according to an embodiment of this disclosure.
Figure 3:
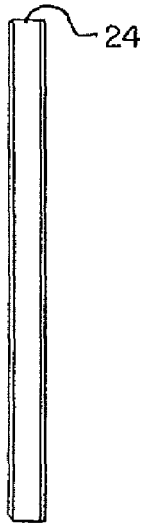
FIG. 3 is a side elevational view of the magnetic frame arrangement according to FIG. 1.
Figure 2:
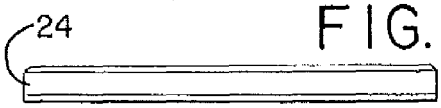
FIG. 2 is a bottom elevational view of the magnetic frame arrangement according to FIG. 1.
Figure 4:
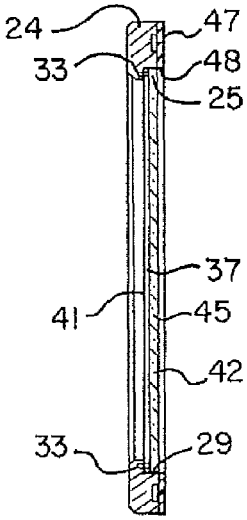
FIG. 4 is a cross-sectional view along the line 4-4 of the magnetic frame arrangement illustrated in FIG. 1.
Figure 5:
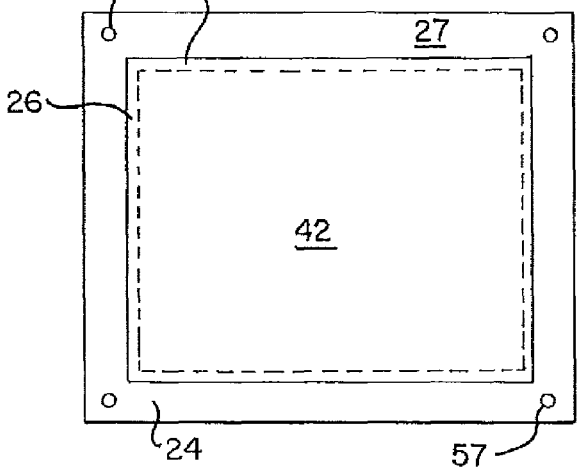
FIG. 5 is a rear plan view of the magnetic frame arrangement according to FIG. 1.

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

FIGS. 1, 2, 3, 4, 5 and 6 illustrate an embodiment of a magnetic frame arrangement, generally designated at 21. Included in this arrangement, assembly or kit is a frame component 22 that defines the bounds of an open central area 23. Frame component 22 has perimeter body or frame body 24. The inside perimeter of body 24 includes or has formed therein a rabbet 25. Rabbet 25 has an instep face 26 that is generally parallel to a rear surface 27 of the frame body 24. This instep face 26 also can be parallel to a front surface 28 of the frame body 24 when the front and rear surfaces are generally parallel to each other.

Various embodiments of the frame component 22 can include a front surface 28 that is decorative and still generally parallel to the rear surface 27. In other embodiments, the front surface is non-parallel, such as being beveled such that the inner edge is of lesser depth than the outer edge, or vice versa, or otherwise exhibits depth gradation along the width of the frame body at its front face. Other examples of non-parallel relationships include front surfaces that are rounded or otherwise of a non-flat topography intended to provide contrast or added interest to the frame as a whole.

Figure 6:
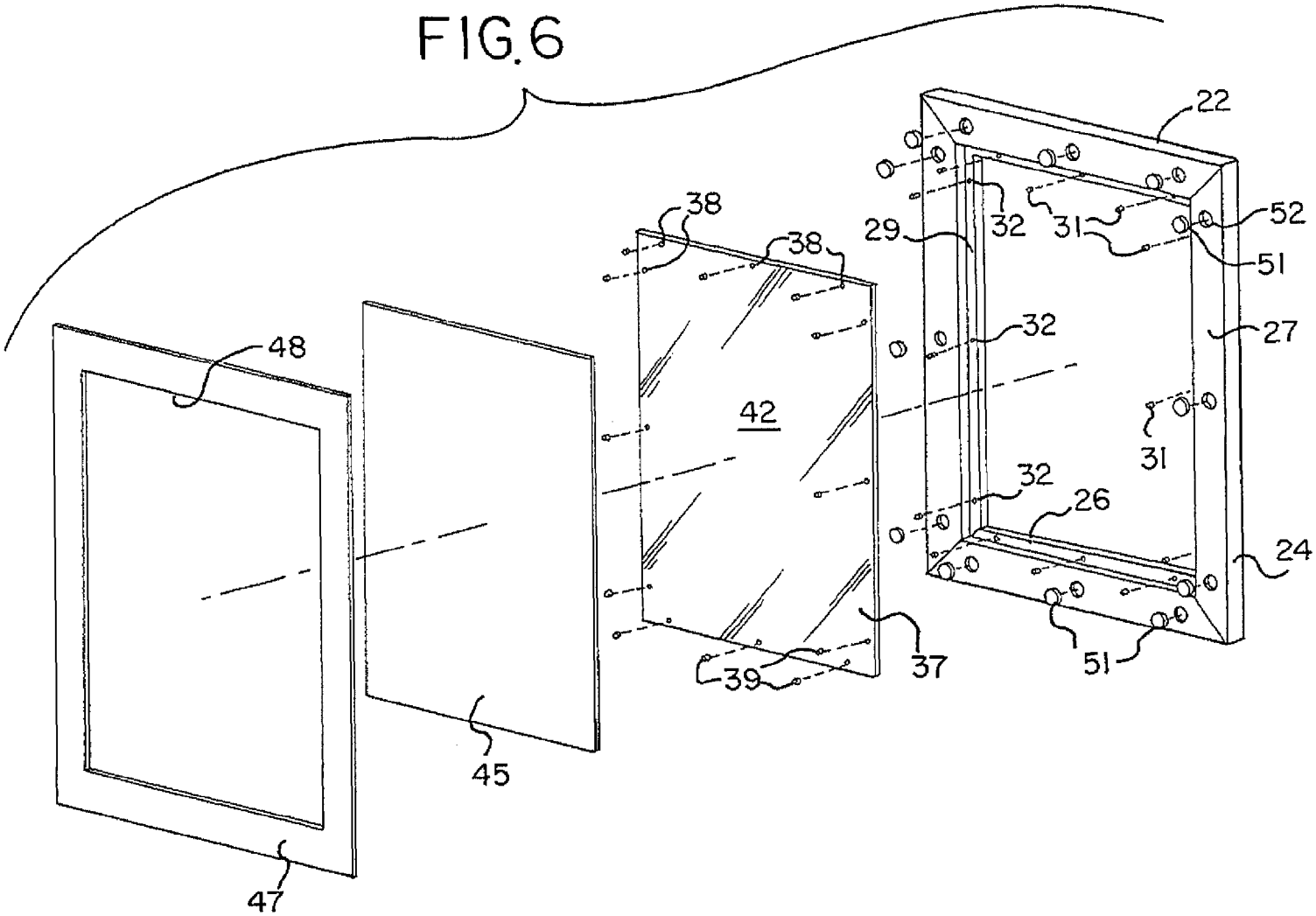
FIG. 6 is an exploded perspective view of the magnetic frame arrangement according to FIG. 1.

With more particular reference to the rabbet 25, the instep face 26 is spaced from the rear surface 27 of the frame component 22 by a depth generally corresponding to the rabbet side wall 29. As perhaps best seen in FIG. 6, rabbet instep face 26 in this illustrated embodiment extends the full inside perimeter of the frame component 22. Instep face 26 includes a plurality of magnets 31 having their respective magnetic forces accessible primarily rearwardly with respect to the frame component 22. In FIG. 6, these magnets 31 are in exploded illustration at a plurality of selected rotations or embedment locations 32. At these selected locations, the respective magnets 31 are mounted to the rabbet instep face 26. Being relatively small magnets, it is important that they be very securely affixed to the rabbet instep face 26. In an embodiment, magnet securement is accomplished by embedding each magnet 31 into an opening of the rabbet of the type generally illustrated at 33 of FIG. 4.

These openings 33 can be preformed to an accommodating depth into the frame component at the rabbet portion thereof. In an embodiment, the preformed openings of this type have a depth substantially the same as the depth of the magnet 31 to be secured thereinto. In a particular embodiment, this opening depth is slightly less than the magnet depth such that the magnet protrudes minimally beyond the instep face 26 of the rabbet. In other embodiments, the magnet and opening can be of exactly the same depth so as to provide the strictly flush relationship. In other embodiments, the magnet face can be recessed into the rabbet at this location.

Figure 13:
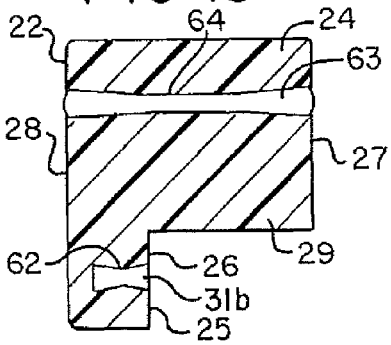
FIG. 13 is a detailed cross-sectional view of a portion of a frame body and rabbet showing another embodiment of a magnet mountings.
Figure 14:
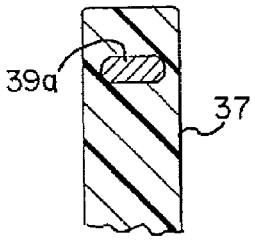
FIG. 14 is a cross-sectional view of a lens component embodiment within which a magnet is internally positioned.
Figure 15:
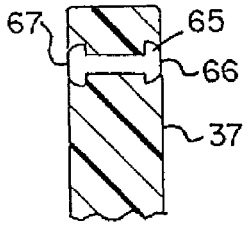
FIG. 15 is another cross-sectional view of a lens component embodiment within which a magnet is securely positioned according to a further embodiment.

Variations in the depth relationship between the magnet face and the rabbet instep face 26 can be used to balance magnetic strengths and forces with respect to other components discussed elsewhere herein. These depth relationship variations can be achieved by choosing a premade hole depth when the premade hole embodiment is practiced. Other embodiments have the magnet securely pressed into the rabbet without a preformed opening, or with a preformed opening that is substantially smaller in diameter than the magnet diameter or width. Other embodiments mold the magnets in place during manufacture such as illustrated in FIG. 13, FIG. 14 and FIG. 15. Depth variations can be accommodated by these types of approaches. Generally, a fully exposed magnet end or face will provide maximum magnetic strength to assembly features of the disclosure, while magnets having an active magnetic face covered by material out of which the frame or lens are made typically will exhibit a reduction in effective magnetic strength.

Also, while cylindrical magnets are illustrated, magnets having other profiles or cross-sections, such as square cross-section sections can be used when same will enhance security of magnet placement on the rabbet. A particular embodiment in this regard provides magnets with serrated walls in the nature of teeth that form indents in the rabbet material, thereby securing same in place. A particular example of this approach includes magnets with threaded walls whereby the magnets can be twisted or screwed into place, discussed more particularly in connection with FIG. 11 and FIG. 12.

Magnet placement on the rabbet can be accompanied by the inclusion of adhesive or glue material in order to provide an added level of security, which may be more necessary for some magnet mounting and/or embedding embodiments. When the magnets can be secured in place without concern for inadvertent removal, such as by applying adherence techniques such as adhesives that are particularly reliable to provide adhesion between the rabbet and the magnet, the openings can be eliminated in the rabbet. Alternatively, only very shallow rabbet openings can be provided when particularly reliable adhesives or other techniques are used.

A further component of the magnetic frame arrangement 21 is a lens 37 that provides a transparent member for protecting items for display within the magnetic frame arrangement while cooperating with other components to securely position the item within the magnetic frame arrangement. While lens 37 can in some embodiments have less than full transparency, such as tinting, translucency, stippling, graining or other decorative embellishments, in its basic form, the lens is substantially transparent. Unless otherwise noted, the use of "transparent" in connection with the lens allows for less than full transparency, such as outlined with these examples.

At a plurality of chosen lens locations 38, respective lens magnets 39 are securely positioned. At least one of these chosen lens locations substantially aligns with at least one of the rabbet selected locations 32, with the result that such lens magnets 39 and rabbet magnets 31 exhibit center-to-center alignment. Whether or not in strict alignment, these respective magnets form magnet pairs. In various embodiments, all or most of the respective magnets at the lens and rabbet locations are magnet pairs.

Each magnet pair has the respective magnet polarities chosen so that one face of each magnet in the pair exhibits opposite polarity or attraction polarity, with the result that magnetic interaction allows the lens 37 to be magnetically secured to the frame component 22, specifically within the rabbet 25 thereof. With such an arrangement, lens 37 has a magnetic attraction orientation with respect to the frame component that is provided by one of its faces. The other face of the lens 37 exhibits a magnetic repulsion orientation (south-to-south or north-to-north) that prevents lens securement to the frame component. In some embodiments, such magnet pairs provide a combined magnetic field or flux effect.

In FIG. 6, an embodiment is illustrated wherein the chosen lens locations 38 include recesses into the lens at those locations. In one embodiment, these recesses are completely through the lens, extending from the magnetic attraction orientation face 41 to the magnetic repulsion orientation face 42. With such an arrangement, such lens magnet 39 is secured within the recess. In one embodiment, opposing faces of the lens magnets are generally flush with the respective faces 41, 42. In other embodiments, either or both of the opposing magnet ends are recessed with respect to one or both of the lens faces 41, 42, and in other embodiments, one or both of the magnet ends protrude beyond one or both of the lens faces 41, 42. Variations in embodiments set out herein regarding rabbet magnet mounting generally are applicable to lens magnet mounting.

For example, in other embodiments, the lens magnets 39 are secured within recesses that are not entirely through the lens; instead, one of the lens faces 41, 42 is continuous or unbroken at one or more of the chosen lens locations. In other embodiments, both lens faces are continuous or unbroken at one or more of the chosen lens locations 38, thereby internally mounting or embedding the lens magnet within the thickness of the lens, thereby providing an especially secure magnet placement. These variations in the depth and extent of the embedding locations of the lens magnets can be used to fine tune or tailor the effective magnitude of magnetic forces that are provided at either or both faces 41, 42 of the lens 37.

A further component of the magnetic frame arrangement, assembly or kit is backing plate 45. Illustrated backing plate 45 is a flat sheet having a perimeter size substantially the same as the perimeter size of the lens 37. In addition, in many embodiments, the perimeter shapes of the lens 37 and backing plate 45 can be substantially identical. Variations in this regard are contemplated depending upon particular design or function objectives. The backing plate is made of a material or otherwise exhibits properties that are receptive to magnetic attraction. Such magnetic attraction is particularly to be exhibited with respect to magnets embedded into the lens, into the rabbet, or both. Such arrangements allow for the backing plate to directly overlie the lens or the rabbet. Examples include the following, in front-to-back order. The frame component or its rabbet overlies the lens, and the lens overlies the backing plate. In another arrangement, the frame component, typically its rabbet, overlies the backing plate, which in turn overlies the lens. Accordingly, a certain degree of interchangeability is afforded by the magnetic frame arrangement, thereby illustrating multipurpose attributes.

For example, when the lens 39 is sandwiched between the rabbet 25 and the backing plate 45, this configuration facilitates display of a decorative or informative sheet between the lens and backing plate, with the decorative or informative indicia or material being visible through the lens 39 from the front surface 28. This orientation provides a display frame function. When the backing plate 45 is sandwiched between the rabbet 25 and the lens 39, a face of the backing plate is directly accessible at the open central area 23 and from the front surface 28 of the frame component 22. In an embodiment, the entirety of the backing plate 45, or at least one face thereof, is chosen to have, or is otherwise treated to exhibit, dry-erase capabilities. In this assembly arrangement, the magnetic frame arrangement functions as an attractive dry-erase board, providing a framed dry-erase board function. As a variation, the lens 39 can be omitted in embodiments of the dry-erase configuration.

An optional feature of the embodiment shown in FIG. 1 through FIG. 6 secures a perimeter cover 47 over the rear surface 27 of the perimeter body or frame body 24. This perimeter cover has an open area 48 larger than the open central area 23 of the frame component 22. The size of this open area 48 is arranged to cover such rear surface 27 without interfering with installation and removal of either the lens 39 or the backing plate 45 in the manner discussed herein. While perimeter cover 47 can provide decorative features, it also can provide a structural function for certain embodiments that include one or more frame body magnets 51 that are accessible from the outside of the frame. Whether perimeter cover 47 is included or not, at least one stand-off 57 is located on the back surface of the assembly to facilitate removal of the unit from a metal wall or the like and to minimize the risk of scratching during "magnetic hanging" and removal of the unit.

Concerning a structural function of the perimeter cover 47, some embodiments include frame body magnets 51 that can be provided when it is desired to have the magnetic frame arrangement 21 also exhibit magnetic mountability onto a separate surface (not shown) to which the arrangement, assembly or kit 21 will magnetically adhere. Such a separate surface could be any surface having magnetic force receptive attributes, such as external walls of refrigerators, other kitchen appliances, metal cabinets and the like. In this manner, the frame body magnets 51 function as hanging or mounting members. Whether one such mounting magnet or multiple mounting magnets 51 are included, they can be embedded within the depth of the frame body 24. In some embodiments, this is accomplished by a preformed hole partially through the frame body, which hole can be countersunk when desired. Adhesive, glue or other securement mechanism can be included for enhancing mounting security.

Another enhancement of mounting security is illustrated by the perimeter cover 47 which hides the frame body magnets 51 from view while also helping to secure them in their designated position. Body frame hole 52 can be open at the rear surface 27 but closed at the front surface 28 of the frame component 22. Depending upon strength of the frame body magnet or magnets 51, it is also possible to have the front surface of the magnetic frame arrangement 21 magnetically adhered to this type of separate surface. This function may require a body frame hole 52 that is deeper than when mounting to separate surfaces is desired with respect to only the rear surface of the magnetic frame arrangement, assembly or kit. Separate front and rear hanging magnets can be provided. In another embodiment, the body frame hole 52 could extend entirely through the frame body thickness, in which event a second perimeter cover (not shown) could be provided for the front face, depending upon aesthetic objectives. In the absence of such a front perimeter cover when the body frame hole is a through aperture and provided each magnet 51 can be otherwise securely fastened, either or both ends of the frame body magnet 51 can remain visible and provide an industrial type of aesthetic.

As with the rabbet magnets 31, the lens magnets 39 and the frame body magnets 51, when incorporated into the system, can take on the various configurations and alternatives discussed herein with respect to the rabbet magnets and the securement thereof to its respective support member. Other approaches in this regard are discussed elsewhere herein.

In the arrangement of FIG. 1 through FIG. 6 embodiments, the frame component can be an assembly of multiple members. In a specific example, polystyrene molding is provided in four mitered lengths 54 chosen to create the desired frame size. Each of the four corners of the molding lengths can be underpinned at their respective miter locations 55 to create a four-sided frame. Keeping with this illustrated embodiment, a plurality of holes are bored at the locations desired for frame body magnets 51. Exemplary holes in this regard can be on the order of ⅜ inch in diameter with a depth of ⅛ inch, while smaller holes, such as 3/16 inch diameter and a depth of ⅛ inch are made at the rabbet selected locations 32. An adhesive such as "superglue", typical an acrylate-based adhesive, can be inserted into the holes or cups for both types of magnets, followed by magnet placement into such holes. Thereafter, double-sided framing tape can be placed on the rear surface of the frame body, by which the perimeter cover 47 is secured into place. Such a perimeter cover can be made of kraft paper dust cover that is in effect adhered to the frame body by the tape.

Continuing with the description of this specific embodiment, a plate of "plexiglass" type of material is provided in a sizing desired for the lens. In this example, 3/16 inch holes are bored into or drilled completely through the lens at the chosen lens locations 38, after which magnets are pressure inserted into each of these bored holes. Typical plexiglass materials are of the acrylic resin variety and can include UV protection components and anti-reflection attributes. The lens is to be tough and durable and able to be drilled, laser cut, bored. Additionally or alternatively, the lens material can be moldable or otherwise subjected to molding techniques by which the lens magnets can be mounted and/or embedded as noted herein.

Continuing further with this specific illustrated embodiment, 24 gauge steel plate is provided in the desired size and dimensions. Other steel gauge can be suitable for given units, such as 22 gauge or less. Also, other materials, typically metallic, can be substituted provided they exhibit the requisite magnetic receptivity to have the plate magnetically interact.

After cleaning, powder coating suitable for dry-erase purposes is applied to both sides of this steel plate in order to provide this backing plate. Coatings of this type can be applied as a high gloss power coat. When all three of these frame, lens and plate components are complete, the frame assembly of this embodiment will be used as a decorative magnetic picture frame or as a decorative magnetic framed dry-erase board. To use as a picture frame, the magnet-infused plexiglass lens is placed into the magnetic-infused rabbet so that the correct poles are facing each other so as to achieve magnetic pole attraction. When assembled, the lens "snaps" onto the rabbet, typically making an audible sound, after which the lens is securely held in place. At this stage, the user can now insert any two-dimensional picture or piece of art against the lens, after which the backing plate is placed over the artwork, typically creating an audible "snapping" sound with the attendant function of securing the decorative sheeting, indicia, informational material or artwork in place between the backing plate and the lens that are adhered together by action of the magnets embedded in the lens and their magnetic interaction with the rabbet magnets. This assembled magnetic frame can now be attached to any steel object, or other magnetically receptive object, displaying whatever decorative sheeting, indicia, informational material or artwork has been placed between the lens and the backing plate.

When used as a dry-erase message board, the user replaces the powder-coated backing plate against the magnet-infused rabbet of the frame, resulting in attachment of the backing plate to the rabbet magnets. Thereafter, the magnet-infused plexiglass lens can be placed against the backing plate so that the correct pole is facing the backing plate, at which time the lens adheres to the backing plate. The frame can now be attached to any steel object, or other magnetic attachment receptor object, and the power-coated backing plate can be used as a framed dry-erase message board within the open area of the frame assembly.

FIGS. 7, 8, 9 and 10 illustrate further embodiments. A magnetic frame arrangement, assembly or kit is generally designated at 121. Included is a frame component 122 that is made of a single piece of material suitable for a frame body. Materials include fiberglass, wood, polymers such as polystyrene, composite material and the like.

A typical one-piece frame can be injection molded or otherwise formed into the desired frame shape. An open central area 123 is defined by the frame component, which includes a perimeter body or frame body 124 having a rabbet 125. The illustrated rabbet has an instep face 126, and the body has a rear surface 127 and a front surface 128. Rabbet sidewall 129 is illustrated in FIG. 10 where rabbet magnets 131 are illustrated exploded from selected rabbet locations 132. When it is desired to have the rabbet structure and its magnetic features manufactured separately from the frame body, such as separate rabbet component and frame body are assembled to form the frame component 122.

The lens 137 of a type generally discussed herein has chosen lens locations 138 designated thereon. As with other embodiments herein, lens magnets 139 can be oriented such that each lens magnet has its "north" polarity end facing in the same direction for each such magnet and its "south" polarity end facing in the opposite direction for each magnet. In this manner, one of the lens faces magnetically attaches to a rabbet exhibiting opposite magnetic polarity. Backing plate 145 is as generally discussed herein with respect to other embodiments, and same can include dry-erase coating to facilitate multipurpose capabilities.

Optional frame body magnets 151 in this illustration are generally thicker than in other embodiments in order to increase magnetic capabilities exhibited by the front of the magnetic frame component by virtue of the magnet being closer to such front face, either slightly recessed therewithin or flush with the front face or slightly projecting therebeyond. In the event that front mounting is practiced in an embodiment, the ease of removal after magnetic mounting is facilitated by providing front stand offs 157 as illustrated in FIG. 7.

Embodiments incorporating the magnetic receptive backing plate, such as one made of steel, allows the steel backing to adhere to the magnets in the lens and a strong yet readily breakable bond is created. By placing artwork, two-dimensional sheets or pictures between the lens and the steel backing, same can be kept in its place and framed, with nothing more than magnets and steel. The material for display, artwork or the like is not held with clips, turn buttons or screws, and magnets are embedded into the rabbet and into the lens in various embodiments in order to create a bond that adheres the lens to the frame. Product placement allows use on a desktop or a wall, as well as on any magnet-receptive surface such as steel objects. Enhancement is created by the multipurpose aspects including use as a dry-erase board, and the product has a variety of uses, multiple placement options and many applications. Variations noted herein, especially with respect to magnet placement and/or embedding apply to these embodiments as well.

With respect to the magnets for the various embodiments, high-strength magnets are used for some or all of the different magnets and different types of magnets in the various embodiments. Examples of high-strength magnets are so-called rare-earth magnets, for example Neodymium magnets. Neodymium magnets are also known as NdFeB, NID or Neo magnets. Other permanent magnets of this type are those of the iron/boron type and of the samarium-cobalt type. Another type of magnet considered for this use is a so-called Alnico magnet, which is composed of aluminum, nickel and cobalt. Others include ceramic magnets and ferrite magnets.

Figure 11:
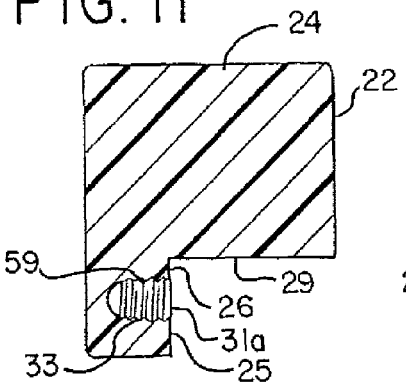
FIG. 11 is a detail cross-sectional view of a portion of a frame body and rabbet showing a further embodiment of magnet mounting.
Figure 12:
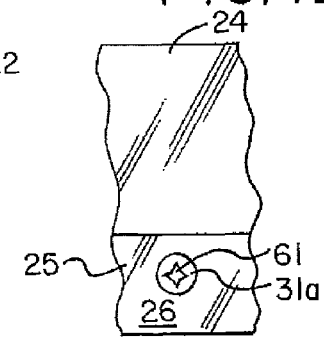
FIG. 12 is a rear elevational view, cut away, of a section of the frame body and rabbet embodiment of FIG. 11.

FIG. 11 and FIG. 12 illustrate a so-called magnetic screw component 31*a* mounted within rabbet 25 from its instep face 26. Magnetic screw 31*a* includes threads 59 that form corresponding threaded surfacing along rabbet opening 33, which may be preformed fully or partially or formed by action of the magnetic screw 31*a*. A tool slot 61, such as for a star-tool wrench or other engagement means is provided by which magnetic screw 31*a* is inserted by applying screwing torque thereto.

FIG. 13 shows other magnet embodiments within the frame body 24 and the rabbet 25. Magnet 31*b* has an internal thickness that is reduced with respect to other portions of the magnet 31*b*. This reduced thickness area is illustrated at 62. Similarly, magnet 63 has a reduced internal area 64. In the case of magnet 31*b*, one of its faces is exposed from the frame, in this case from the frame rabbet. In the case of magnet 63, both of its opposing faces are exposed from the frame, in this case the rear surface 27 and the front surface 28 of the frame body 24. These types of magnets 31*b* and 63 are particularly suitable when the frame component 22 is a molded unit and the magnets can be molded in place by insertion injection molding and/or other techniques. One of ordinary skill will recognize that molding techniques are available to combine parts of different materials and/or to encapsulate one part into another. In this instance, the metallic magnet is molded-in-place during polymer injection molding or other suitable molding technique. In the particular situation of a frame having a rabbet magnet of the type illustrated at 31*b*, same likewise could be molded in place, whether as a one-piece frame component or as a rabbet separately molded and subsequently attached to the frame body. These various types of magnets can be positioned in these and other embodiments noted herein.

FIG. 14 and FIG. 15 illustrate lens magnets 39*a* and 65, respectively. In each case, these magnets can be molded in place, such as by capture molding techniques, within a lens 37 or other component having an embedded magnet. Magnet 39*a* is fully embedded within the illustrated lens 37. Magnet 65 is also embedded, but its opposing faces 66, 67 are exposed and uncovered by lens material. In this regard, when 67 differs from lens 39*a*, which is fully embedded.

Figure 16:
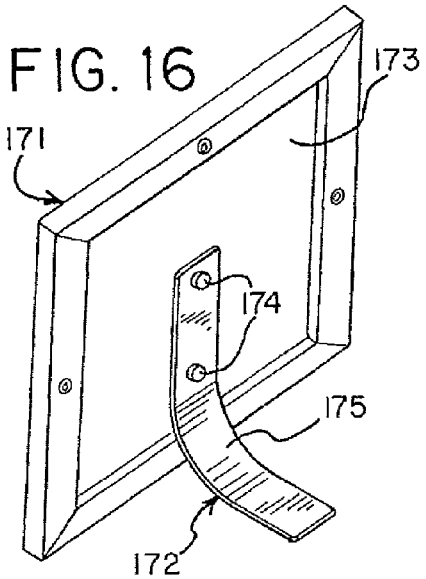
FIG. 16 is a perspective view of a frame embodiment in combination with a bracket stand having magnetic affixing attributes.

FIG. 16 shows a further embodiment of a magnetic frame assembly, generally designated as 171, that includes in its combination a magnetic stand 172 suitable for displaying on a horizontal surface. It will be appreciated from this disclosure that the back surface 173 of the frame unit 171 is receptive to magnetic attractive forces. For example, back surface 173 can be a backing plate as discussed herein. In this regard, magnetic stand 172 includes one or more magnets 174 mounted on a support bracket 175.

Figure 17:
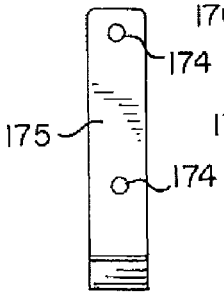
FIG. 17 is an elevational view of the bracket stand illustrated in FIG. 16.
Figure 18:
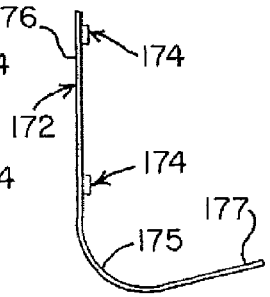
FIG. 18 is a cross-sectional view of the bracket stand illustrated in FIG. 16.

While support bracket 175 can take on any number of different configurations, the illustrated embodiment is further depicted in FIG. 17 and FIG. 18 as being a relatively thin strap into which magnets 174 are suitably encapsulated. The particular illustrated structure is generally V-shaped, having an upstanding leg 176 and a base leg 177. Legs 176 and 177 are disposed at an acute angle with respect to each other and can be connected by way of a curved portion as illustrated best in FIG. 18. A typical acute angle is on the order of between about 70° and 85°, which acute angle defines the level at which the frame arrangement 171 is offset from vertical with respect to a horizontal surface upon which the combination is mounted. Magnetic forces hold the magnetic stand 172 onto the back of the magnetic frame arrangement 171, allowing removal without requiring tools. It will be appreciated that multiple magnetic stands 172 can be provided and that its shape and dimensions shown in FIGS. 16, 17 and 18 are for illustrative purposes only.

It will be understood that the embodiments described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims, and it is understood that claims may be directed to the features hereof, including as combinations of features that are individually disclosed or claimed herein.

The invention claimed is:

1. A magnetic frame arrangement comprising:

a frame component having a perimeter body with a first surface and an oppositely facing second surface, an open central area, and a rabbet along at least a portion of the frame component between the perimeter body and the open area, the rabbet having an instep face generally parallel to the second surface and between the first and second surfaces;

at least one magnet located at the second surface of the perimeter body;

a plurality of magnets embedded at selected rabbet locations into the instep face of the rabbet;

a substantially transparent lens having a plurality of magnets embedded thereinto at a plurality of lens locations at least some of which substantially align with at least some of said selected rabbet locations of the rabbet; and a backing plate receptive to magnetic attraction with respect to the magnets embedded into the lens, the instep face or both.

2. The magnetic frame arrangement according to claim 1, wherein the backing plate has a dry-erase coating on at least one of its faces.

3. The magnetic frame arrangement according to claim 1, wherein the a plurality of the magnets embedded into the instep face of the rabbet, or a plurality of the magnets embedded into the lens, or both are mounted within respective openings at the respective selected rabbet locations, lens locations or both.

4. The magnetic frame arrangement according to claim 3, wherein the respective openings are partially through the rabbet and fully through the lens.

5. The magnetic frame arrangement according to claim 4, wherein the at least one magnet located at the second surface of the perimeter body is partially through the perimeter body.

6. The magnetic frame arrangement according to claim 3, wherein the openings are preformed in the rabbet, the lens, or both.

7. The magnetic frame arrangement according to claim 3, wherein the openings are at least partially formed in the rabbet, the lens, or both during insertion of the respective magnets.

8. The magnetic frame arrangement according to claim 7, wherein at least some of the respective magnets are externally threaded magnets.

9. The magnetic frame arrangement according to claim 3, wherein the openings are formed for the respective magnets by insert injection molding of the rabbet, the lens, or both.

10. The magnetic frame arrangement according to claim 3, wherein at least some of the respective magnets have at least one portion thereof that is of greater or smaller cross-section than another portion thereof.

11. The magnetic frame arrangement according to claim 1, further including a magnetic stand that is exclusively magnetically securable to the backing plate.

12. A multipurpose magnetic frame arrangement comprising:

a frame component having a perimeter body with a first surface and an oppositely facing second surface, an open central area, and a rabbet along the interior perimeter of the perimeter body to define the open central area, the rabbet having a step-down ledge generally parallel to the second surface and between the first and second surfaces;

at least one magnet located at the second surface of the perimeter body;

a plurality of magnets embedded at selected locations into the step-down ledge of the rabbet;

a substantially transparent lens having a plurality of lens magnets embedded thereinto at a plurality of lens locations at least some of said lens magnets substantially align with at least some of said magnets embedded at selected locations of the rabbet as pairs of aligned magnets;

a backing plate receptive to magnetic attraction with respect to the magnets embedded into either the lens or into the step-down ledge, said backing plate having at least one surface with dry-erase capabilities; and said pairs of aligned magnets selectively magnetically engage and disengage the frame component, the lens and the backing plate in a front-to-back order of either frame component over lens over backing plate or frame component over backing plate over lens.

13. The multipurpose magnetic frame arrangement according to claim 12, wherein the plurality of the magnets embedded into the step-down ledge of the rabbet, or the plurality of the lens magnets embedded into the lens, or both are mounted within respective openings at the respective selected rabbet locations, lens locations or both.

14. The multipurpose magnetic frame arrangement according to claim 13, wherein at least some of the respective magnets have at least one portion thereof that is of greater or smaller cross-section than another portion thereof.

15. A multipurpose magnetic frame kit purposed for either picture framing or dry-erase board uses, comprising:

a frame component having a frame body with a first surface and an oppositely facing second surface, an open central area, and a rabbet along the interior perimeter of the frame body to define the open central area, the rabbet having a step-down ledge generally parallel to the second surface and between the first and second surfaces;

a plurality of kit-securing magnets located at the second surface of the frame body, these magnets being countersunk within the frame body from its second surface and being configured to magnetically secure the multipurpose kit to a surface that is separate from the multipurpose magnetic frame kit to which the kit-securing magnets magnetically adhere;

the first surface of the frame body being decorative;

a plurality of magnets embedded at selected locations into the step-down ledge of the rabbet;

a substantially transparent lens having a plurality of lens magnets embedded thereinto at a plurality of lens locations at least some of said lens magnets substantially align with at least some of said magnets embedded at selected locations of the rabbet, as pairs of aligned magnets;

a backing plate receptive to magnetic attraction with respect to the magnets embedded into the lens, the step-down ledge or both, said backing plate having at least one surface with dry-erase capabilities; and said pairs of aligned magnets selectively magnetically engage and disengage the frame component, the lens and the backing plate in a front-to-back order of either frame component over lens over backing plate or frame component over backing plate over lens.

16. The multipurpose magnetic frame kit according to claim 15, wherein the plurality of the magnets embedded into the instep face step-down ledge of the rabbet, or a plurality of the lens magnets embedded into the lens, or both are mounted within respective openings at the respective selected rabbet locations, lens locations or both, and wherein at least some of the respective magnets have at least one portion thereof that is of greater or smaller cross-section than another portion thereof.

17. The multipurpose magnetic frame kit according to claim 16, wherein at least some of the respective magnets are externally threaded magnets.

18. A magnetic frame comprising:

a frame component having a frame body with a first surface and an oppositely facing second surface, an open central area, and a rabbet along at least a portion of the frame component between the frame body and the open area, the rabbet having an instep face generally parallel to the second surface and between the first and second surfaces;

a plurality of magnets embedded at selected locations into the instep face of the rabbet;

a substantially transparent lens having a plurality of magnets embedded thereinto at a plurality of lens locations at least some of which substantially align with at least some of said selected locations of the rabbet; and a backing plate receptive to magnetic attraction with respect to the magnets embedded into the lens, the instep face or both, whereby the lens and the backing plate both magnetically engage and magnetically disengage from each other and from the rabbet so as to be configured to display a decorative or informative sheet between the backing plate and the lens such that the sheet is visible at the open area of the frame.

19. The magnetic frame according to claim 18, further including a magnetic stand that is exclusively magnetically securable to the backing plate.

20. The magnetic frame according to claim 18, wherein the a plurality of the magnets embedded into the instep face of the rabbet, or a plurality of the magnets embedded into the lens, or both are mounted within respective openings at the respective selected rabbet locations, lens locations or both.

* * * * *